US006386356B1

(12) United States Patent
Eberle

(10) Patent No.: US 6,386,356 B1
(45) Date of Patent: May 14, 2002

(54) CONVEYING MEANS WHICH CAN BE RAIL-GUIDED AND A GUIDING RAIL FOR GUIDING SAID CONVEYING MEANS

(75) Inventor: Jürg Eberle, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/555,319

(22) PCT Filed: Dec. 9, 1998

(86) PCT No.: PCT/CH98/00523

§ 371 Date: May 22, 2000

§ 102(e) Date: May 22, 2000

(87) PCT Pub. No.: WO99/33730

PCT Pub. Date: Jul. 8, 1999

(30) Foreign Application Priority Data

Dec. 23, 1997 (CH) ..... 2962/97

(51) Int. Cl.[7] ..... B65G 29/00

(52) U.S. Cl. ..... 198/867.01; 198/687.1

(58) Field of Search ..... 198/687.1, 465.1, 198/465.4, 867.14, 867.13, 867.01, 795

(56) References Cited

U.S. PATENT DOCUMENTS

| | | | | |
|---|---|---|---|---|
| 3,902,587 A | * | 9/1975 | Checcucci | 198/465.1 |
| 4,007,824 A | | 2/1977 | Reist | 198/462 |
| 5,255,776 A | * | 10/1993 | Grecksch et al. | 198/465.1 |
| 5,261,520 A | | 11/1993 | Duke | 198/375 |
| 5,280,830 A | * | 1/1994 | Schiaretti et al. | 198/795 |
| 5,975,280 A | * | 11/1999 | Cote et al. | 198/795 |
| 6,007,064 A | * | 12/1999 | Cote et al. | 198/465.4 |

* cited by examiner

*Primary Examiner*—Joseph E. Valenza
(74) *Attorney, Agent, or Firm*—Brinks Hofer Gilson & Lione

(57) ABSTRACT

The invention relates to conveying means (1) which can be rail-guided and are provided for conveying especially flat products in a conveying direction (F). Said conveying means comprises a guiding part (2) which runs in a v-shaped manner in a conveying direction and constructs a three point support. In addition the conveying means comprises a supporting part (3) which is provided for holding the product and arranged in fixed manner on the guiding part (2). The conveying means also have a coupling part (4) which is arranged on a driving means (9) such that it can be coupled.

18 Claims, 3 Drawing Sheets

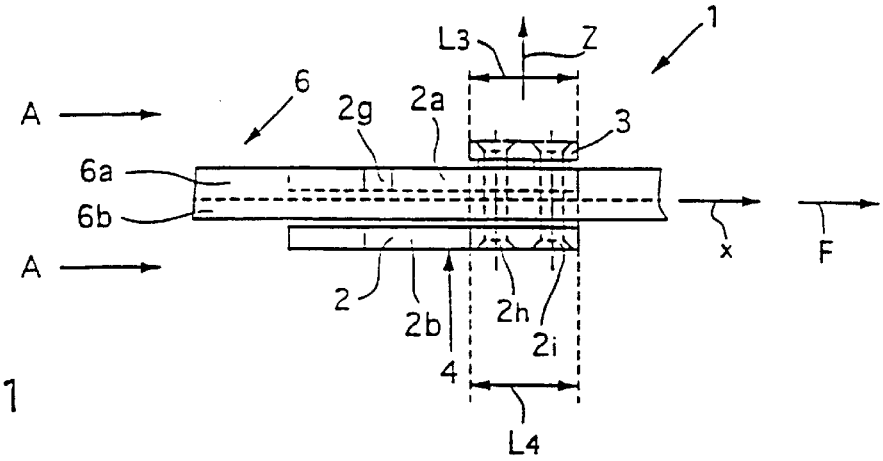
Fig.1
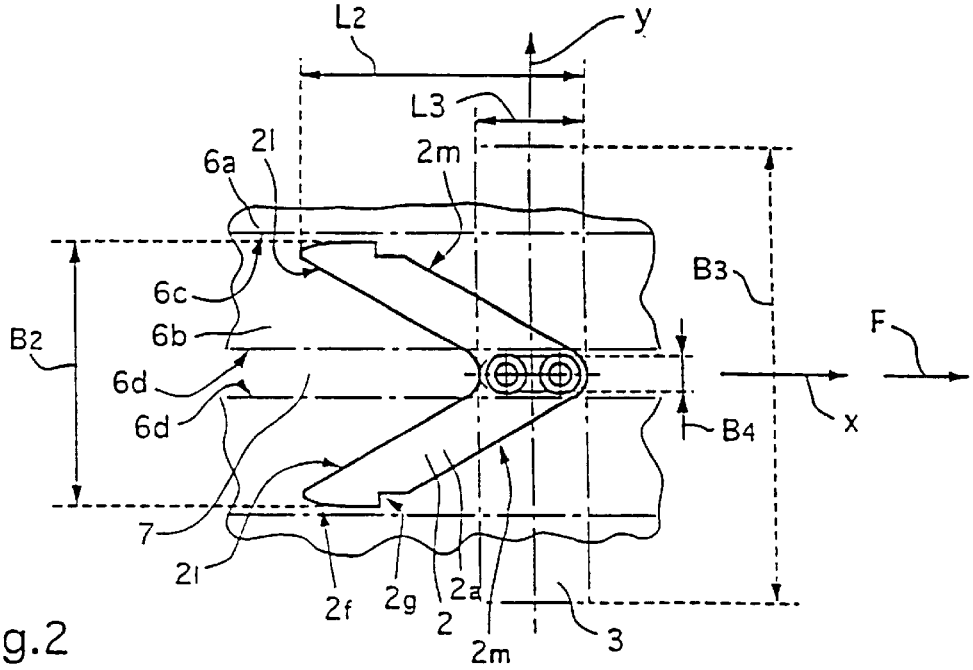
Fig.2
Fig.3 (A-A)
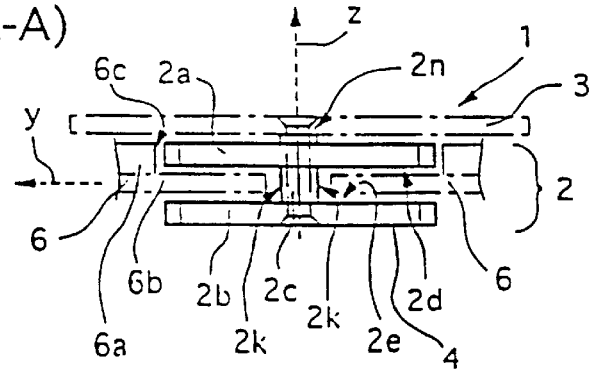

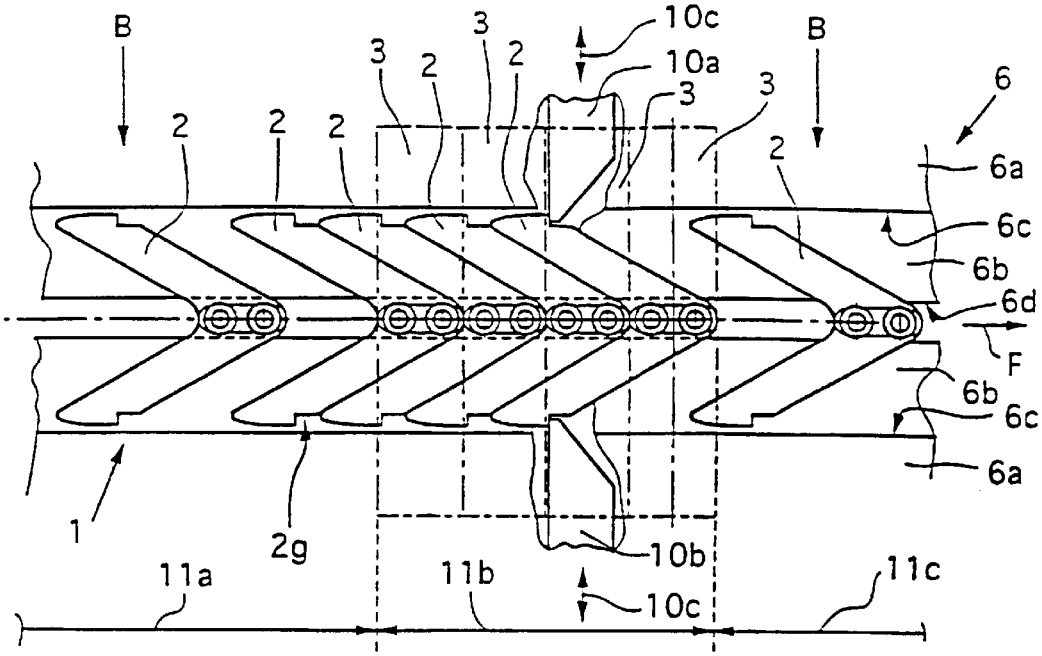
Fig.4
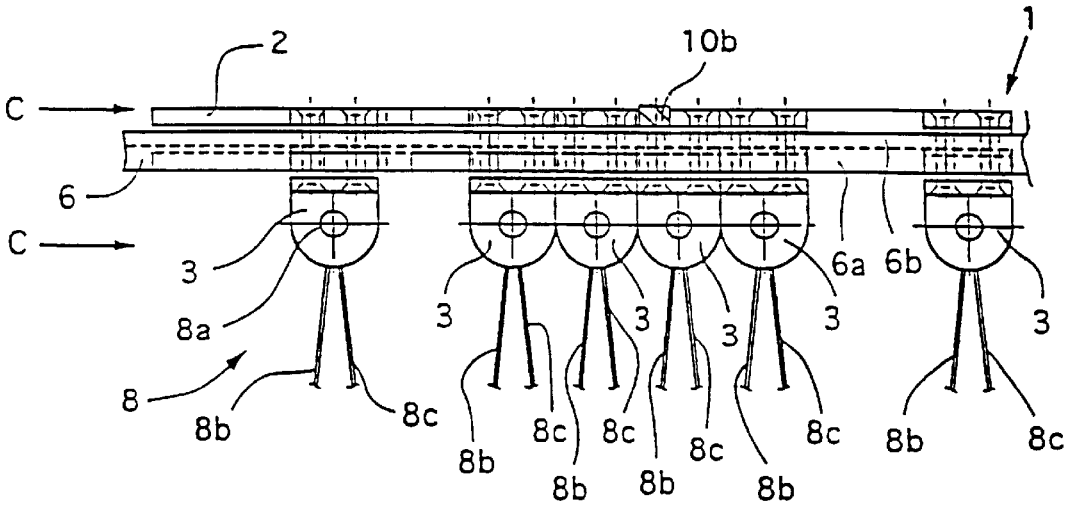
Fig.5 (B-B)
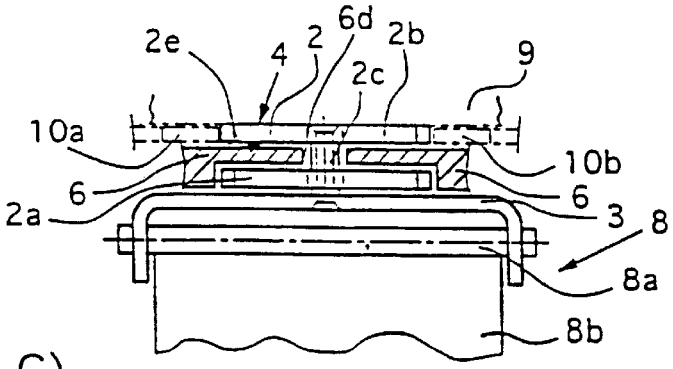
Fig.6 (C-C)

Fig.7
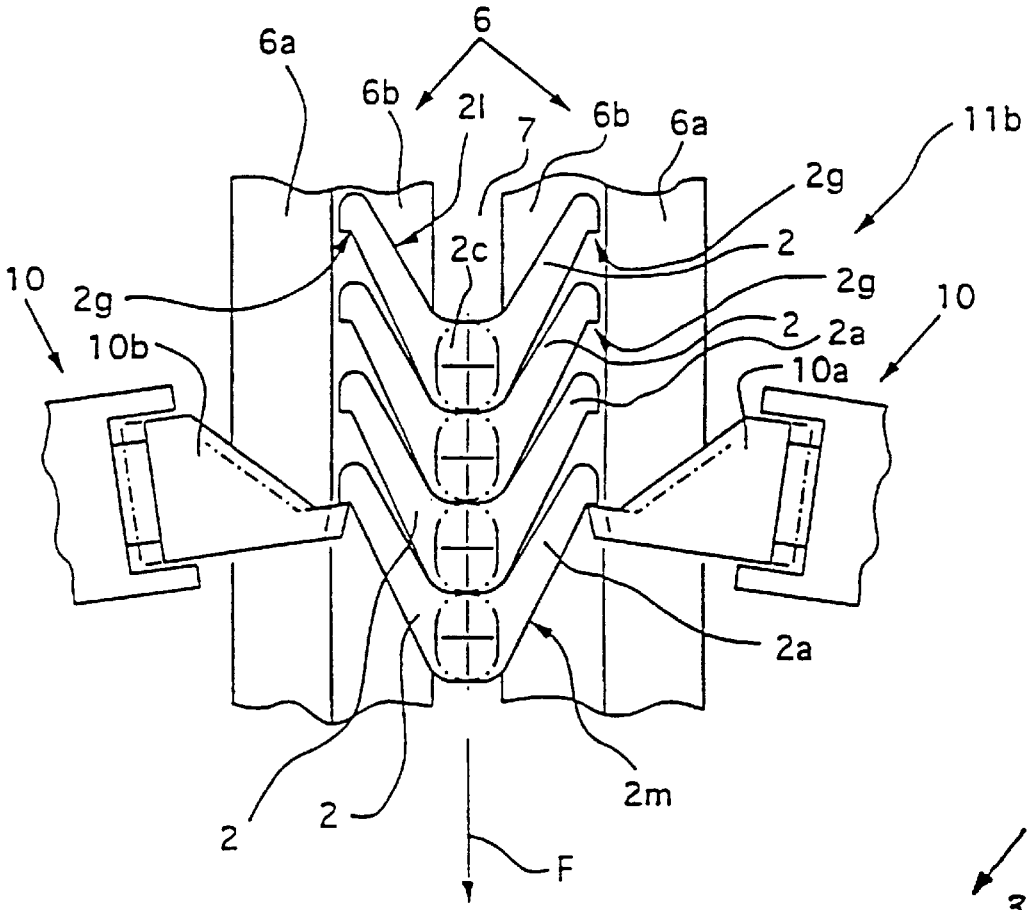
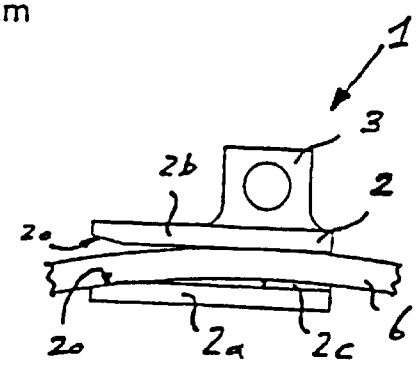
Fig. 9
Fig.8
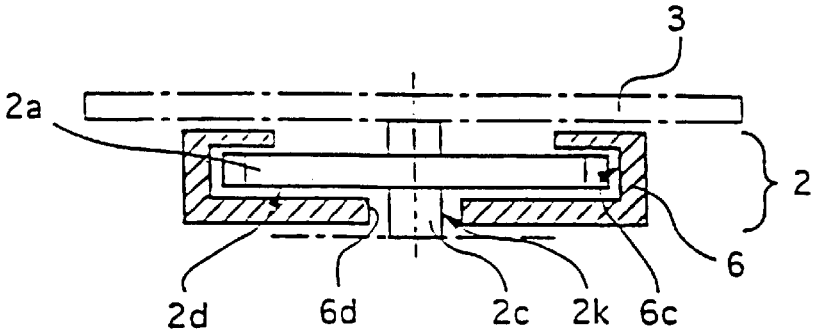

CONVEYING MEANS WHICH CAN BE RAIL-GUIDED AND A GUIDING RAIL FOR GUIDING SAID CONVEYING MEANS

The invention relates to a rail-guidable conveying means for conveying, sheet-like products in a conveying direction. The invention also relates to a guide rail for guiding a conveying means comprising a guide port running in the form of a V in the conveying direction and forming a three-point support.

A rail-guidable conveying means for printed 10 products is known from Patent CH 382 768. A plurality of conveying means fixed to the rail allow printed products to be gripped, conveyed along the rail and deposited at a remote location.

The disadvantage with this known arrangement is the fact that the conveying means are spaced apart by a relatively large distance, and the printed products can thus only be conveyed with low density.

An object of the invention is to develop a rail-guidable conveying means such that the conveying means arranged on a rail make it possible to convey a high-density product stream.

This object is achieved by a rail-guidable conveying means having a guide part in the form of a V that forms a three point support. A carrying part, that functions to retain the product, is fixed to the guide part and there is a coupling part that is coupled to a drive means. The H-shaped configuration of the guide part comprising two spaced apart V-shaped sliding bodies and connected by a cross piece provide further advantageous configurations of the rail-guidable conveying means. The object is also achieved by a guide rail which has two parallel rails that form a gap and are configured to adapt to the H-shaped guide means such that the crosspiece can be mounted in the gap and each sliding body rest on opposite sides of the rails. Further advantageous configurations of the guide rail is that the distance between the gap and the inner surface is selected such that the inner surface forms a lateral directing surface for the sliding body of the guide part and the guide part is arranged on the rail such that it has an amount of play.

The object is achieved, in particular, by a rail-guidable conveying means for conveying, in particular, sheet-like products in a conveying direction, having a guide part, which runs in the form of a V in the conveying direction (F) and forms a three-point support, a carrying part, which is arranged firmly on the guide part and is intended for retaining the product, and a coupling part, which is configured such that it can be coupled to a drive means. In an advantageous embodiment, the rail-guidable conveying means has a guide part which is of H-shaped configuration in a plane normal to the conveying direction.

In contrast to the known conveying means, in which each retaining means provided for conveying a product is arranged on a separate, rail-guided carriage, the conveying means according to the invention, eliminating a carriage, has a guide part with a preferably H-shaped cross section. Configured in adaptation to the guide part, two spaced-apart rails are provided. The two interspaces of the H-shaped guide part can be introduced into the two spaced-apart rails, with the result that the guide part is mounted such that it can be displaced in a conveying direction F, which is determined by the course of the rails. The guide part does not have any wheels and, retained by the H-shaped configuration, slides in a reliably guided manner in the running direction of the rail. The guide part is of V-shaped configuration in the conveying direction, in order for a more stable sliding behavior to be imparted to the guide part and for moments which may act on the guide part to be transmitted to the rails without the risk of canting. In addition, the V-shaped configuration allows large-surface-area support of the guide part on the rail. The guide part is configured as a slider which is of, in particular, wide-legged configuration and forms a three-point support in relation to the guide rail, with the result that the slider is guided in a rotationally fixed manner on the guide rail.

One advantage of the conveying means according to the invention is that it is of very short construction in the conveying direction. For example, a multiplicity of conveying means can be lined up on a rail in contact with one another and thus closely one behind the other. Since each conveying means has a retaining device for retaining a product, for example a printed product, a very dense product stream can be conveyed by the conveying means according to the invention. This allows a high conveying density to be achieved, even at a very low conveying speed. In addition, the conveying means may be configured so as to be very small and very lightweight.

A further advantage of the conveying means according to the invention is that the drive device need not be coupled firmly to the conveying means. If he rail slopes downward, the conveying means may be driven, for example, by the gravitational force acting thereon. If the rail slopes upward, a chain comprising a plurality of conveying means in contact with one another may be formed, that conveying means which is arranged right at the back of the chain in each case being moved in the conveying direction by a drive means, and the conveying means which are located in front of the back conveying means being pushed along correspondingly. It is also possible for at least in each case one conveying means to be gripped, and conveyed along the rail, by a driven carriage which runs parallel to the rail. In an advantageous configuration, the rail-guided conveying means has a relatively large amount of play in relation to the rail, the carriage being arranged to run in relation to the rail such that a conveying means coupled firmly to the carriage is conveyed largely without contact with the rail. As long as the conveying means is coupled firmly to the carriage, the conveying means does not necessarily require a directing rail, since the conveying direction is determined by the running direction of the carriage. The rail may thus be configured with an outlet region, in order to separate the conveying means from engagement with the rail, or the rail may be configured with an inlet region, in order for the conveying means which is moved by the carriage without the use of a rail to be transferred into engagement with the rail again.

In an advantageous configuration, the guide part of the conveying means has an engagement surface which is configured for engagement with a release device in order for the latter to retain and let go of the guide part in a controllable manner.

It is possible to fasten on the carrying part of the conveying means according to the invention retaining means which may be configured in a large number of variants in order to retain and/or to convey a large number of products configured in a wide range of different ways and having a wide range of different geometrical shapes. The conveying means according to the invention is suitable, in particular, for conveying sheet-like products, for example printed products, cardboard, flat glass, frames, clothes or metal sheets.

Further embodiments and applications of the rail-guidable conveying means are disclosed in CH Patent Applications Nos 1997 2963/97 and 1997 2965/97

(Representative's references A12207CH, A12205CH) by the same applicant, said applications being filed on the same day and having the titles "Fördereinrichtung" [Conveying apparatus] and "Fördersystem" [Conveying system].

The invention is explained hereinbelow, by way of a number of exemplary embodiments, with reference to the drawings, in which:

FIG. 1 shows a side view of a rail-guidable conveying means arranged in a rail;

FIG. 2 shows a plan view of the conveying means according to FIG. 1;

FIG. 3 shows a side view of the conveying means according to FIG. 1 from the viewing direction A—A;

FIG. 4 shows a plurality of conveying means arranged one behind the other on the rails;

FIG. 5 shows a side view of the conveying means according to FIG. 4 from the viewing direction B—B;

FIG. 6 shows a side view of the conveying means according to FIG. 5 from the viewing direction C—C;

FIG. 7 shows a plurality of further conveying means arranged one behind the other on the rail;

FIGS. 8, 9 show further exemplary embodiments of rail-guidable conveying means.

The same rail-guidable conveying means 1 is illustrated in a side view in FIG. 1, in a plan view in FIG. 2 and in a side view, from direction A—A, in FIG. 3. A rail 6, part of which is illustrated merely by dashed lines, comprises two rail parts 6*b* which are spaced apart from one another to form a gap 7. This gap 7 forms a first guide and defines the conveying direction F of the conveying means 1. In order to describe the conveying means 1, a system of Cartesian coordinates with directions X, Y and Z is depicted as an aid in the three figures, the X-direction being congruent with the conveying direction F.

The conveying means 1 comprises a guide part 2 which runs in the form of a V in the conveying direction F and is of H-shaped configuration in a plane normal to the conveying direction F, as can be seen from FIG. 3. The conveying means 1 also comprises a carrying part 3, which is arranged firmly on the guide part 2 and is intended for retaining a product, and a coupling part 4, which is configured such that it can be coupled to the drive means 9 (FIG. 6). The guide part 2 comprises two V-shaped sliding bodies 2*a*, 2*b* which are spaced apart perpendicularly to the conveying direction F, or in the Z-direction, and are connected by a crosspiece 2*c*. In the exemplary embodiment illustrated, the sliding bodies 2*a*, 2*b* are configured and arranged so as to be congruent in the Z-direction. The only difference between the two sliding bodies 2*a*, 2*b* is that the top sliding body 2*a* has, on both sides, a notch 2*g* which is arranged in the end region and is intended for the engagement of a restraining finger 10*a*, 10*b* of a stop and release device 10 (FIG. 4, FIG. 5, FIG. 7). It would also be possible for the two sliding bodies 2*a*, 2*b* to be configured differently from one another and to have different lengths, for example, in relation to X-direction.

The sliding bodies 2*a*, 2*b* have two mutually facing surfaces 2*d*, 2*e*, which are spaced apart from one another such that the rail part 6*b* is located between them with an amount of play. The V-shaped configuration of the sliding bodies 2*a*, 2*b* allows the surfaces 2*d*, 2*e* to be configured so as to have relatively large surface areas, with the result that the sliding body 2*a*, 2*b* can rest on the rail 6 such that it is supported over a large surface area.

The crosspiece 2*c* of the guide part 2 has two lateral sliding surfaces 2*k* running in the conveying direction F. The guide part 2 comprises a plurality of individual parts, namely the sliding bodies 2*a*, 2*b*, the crosspiece 2*c* and two screws 2*h*, 2*i*. In addition, the carrying part 3 is fixed to the guide part 2 by the screws 2*h*, 2*i*. It would also be possible for the guide part 2 to be designed in one piece. The guide part 2 may consist of plastic. The guide part 2 may also have ferromagnetic properties and consist of a metal part or contain, for example, iron powder which is incorporated in a plastic. The sliding body 2*b* advantageously has ferromagnetic properties.

Each sliding body 2*a*, 2*b* has two side arms which together form the V-shaped configuration, each of the side arms having a leading edge 2*m* and a trailing edge 21 in relation to the conveying direction F. In the exemplary embodiment illustrated, the two edges 2*m*, 21 are configured so as to run parallel to one another or virtually parallel to one another. This configuration has the advantage that a plurality of guide parts 2 in contact with one another are mounted in a very stable manner. The abutting guide parts 2 are coupled relatively rigidly to one another and form a type of bar. The conveyable objects conveyed or retained on the guide parts can easily be manipulated in this bar-like position of the guide parts 2 since the guide parts 2 are supported against one another and are therefore in a very stable position.

In the end region, the side arms form a side surface 2*f* which is configured so as to run approximately parallel to the sliding surface 2*k*. Said side surface 2*f* serves for supporting the guide part 2 in the Y-direction if the rail 6 is provided with guide parts 6*a* forming of a [sic] inner surface 6*c*. These guide parts 6*a*, which form a second guide, as can be seen from FIG. 1 and FIG. 3, are arranged on the rail part 6*b* and serve, in particular, for absorbing a torque which runs in the Z-direction and acts on the guide part 2.

The crosspiece 2*c* has an overall length L4 in the conveying direction F and a width B4 in the Y-direction, which runs perpendicularly to the conveying direction F, the overall length L4 being three times the width B4. The rail 6 forms a gap 7 with inner surfaces 6*d*. The guide part 2 is guided by the engagement of the crosspiece 2*c* in the gap 7. In order to prevent canting of the crosspiece 2*c* in the rail 6, the overall length L4 of the crosspiece 2*c* is at least twice the width B4 of the same.

The guide part 2 has an overall length L2 in the X-direction and an overall width B2 in the Y-direction. The carrying part 3, which runs transversely to the conveying direction F and is illustrated by dashed lines, has a length L3 in the X-direction and a width B3 in the Y-direction. In the exemplary embodiment illustrated, the length L4 of the crosspiece 2*c* is identical to the length L3 of the carrying part 3. In order to ensure that the guide part 2 slides in the rail 6 in a stable manner without canting, the overall length L2 of the guide part 2 is preferably at least 1.5 times the overall length L4 of the crosspiece 2*c*.

The guide part 2 has a fastening surface 2*n* on which differently configured carrying parts 3 and/or retaining means 8 can be fastened, for example by means of a screw.

FIG. 4 shows a plurality of conveying means 1 arranged one behind the other on the rail 6. For the sake of clarity, it is only the guide parts 2 of the conveying means 1 which are illustrated in full, whereas carrying parts 3 associated with the conveying means 1 are only illustrated partially, by dashed lines. FIG. 4 also shows a stop and release device 10 which comprises two restraining fingers 10*a*, 10*b* which can be displaced in the movement direction 10*c* and engage in the notch 2*g* of the guide part 2 in order to retain the guide part 2 and release it again in a controllable manner by letting it go. This stop and release device 10 can restrain the guide parts 2, with the result that the guide parts 2 are in contact with one another in the guiding direction F and form a buffer region 11*b* over a length section of the rail 6. Located upstream of the buffer region 11*b* is an inlet region 11*a*, within which a guide part 2 advances toward the buffer region 11*b* in a freely movable manner. Arranged downstream of the buffer region 11 is a further region 11*c*, within which the guide parts 2, preferably spaced apart from one another, move in the conveying direction F again.

All the carrying parts 3 are depicted in FIG. 5, which illustrates a side view of FIG. 4 from the viewing direction B—B. Each conveying means 1 comprises a guide part 2, a carrying part 3 and a retaining means 8, which is fastened on the carrying part. The retaining means 8, comprising an articulation 8*a* and two tongues 8*b*, 8*c*, is preferably configured such that the conveyed product, for example a printed product, is retained such that it runs perpendicularly, or approximately perpendicularly, to the conveying direction F.

FIG. 6 shows, in a side view of FIG. 5 from the direction C—C, the retaining means 8, which is connected to the guide part 2 via the carrying part 3. The guide part 2 is fixed to a drive means 9, which is indicated in outline, via the coupling part 4. This form-fitting or force-fitting connection of the guide part 2 to the drive means 9 may be configured in different ways such that the guide part 2 is fixed to the drive means 9 in a releasable manner. In a preferred embodiment, the sliding body 2*b* has ferromagnetic properties and thus forms the coupling part 4 at the same time. The drive means 9 has a magnet, with the result that the sliding body 2*b* is thus fixed to the guide part 2 in a releasable manner by a magnetically acting, force-fitting connection. It would also be possible for the guide part 2 to consist of a non-ferromagnetic material, for example also of a plastic, the guide part 2 having, on the surface which is directed toward the drive means 9, a ferromagnetic part which forms the coupling part 4.

The drive means 9, configured, for example, as a carriage or a belt, is arranged so as to be spaced apart from the rail 6 and to run parallel to the same. The play which is produced between the guide part 2 and the rail 6 may be such that, in the case of a guide part 2 conveyed by a drive means 9, there is hardly any contact, if any at all, with the rail 6. If the guide part 2 is released from the drive means 9, then the guide part 2 rests on the rail 6, usually by way of the surface 2*e* of the sliding body 2*b*.

FIG. 7 shows a further exemplary embodiment of a vertically running rail 6 with guide parts 2 forming a buffer region 11*b*. The release device 10 with restraining fingers 10*a*, 10*b* allows the guide parts 2 to be released individually and in a controlled manner. The guide parts 2 have a sliding body 2*a* with a leg which tapers in a wedge-shaped manner in the outward direction. This configuration results in a larger free space between the hoes [sic] 2*g*, which are arranged one after the other in the conveying direction F, with the result that said guide parts 2 can be manipulated particularly easily and reliably by the stop and release device 10. The stop and release device 10 allows the guide parts 2 to be stopped, retained and released again. The embodiment of the guide parts 2 with sliding bodies 2*a* which taper in a wedge-shaped manner in the outward direction, said embodiment being illustrated in FIG. 7, has the advantage that in the state in which they are in contact with one another, as is illustrated in FIG. 7, the guide parts 2 can be conveyed along rail paths which are curved in any desired manner. The guide parts 2 may be conveyed, in particular, very easily along a guide rail 6 which runs in a curved manner within the viewing plane, since the legs of the guide parts 2, which taper in a wedge-shaped manner in the outward direction, allowing mutual rotation about an axis of rotation running perpendicular to the viewing plane. In the state in which the guide parts are in contact with one another, a type of "curved bar" is thus formed.

Of course, it is also possible for the guide part 2 to be conveyed along the rail 6 in a direction counter to the conveying direction F. The guide part 2 according to the invention has the advantage that the rail 6 can be routed in any desired manner in space, and the guide part 2 is guided reliably on the rail 6 in any position.

FIG. 8 shows a cross section through a guide rail 6 which is of U-shaped configuration on both sides and has a gap for a protrusion 2*c* of a guide part 2 configured as a slider 2. The slider 2 is configured as a V-shaped body and comprises a first sliding body 2*a* and the crosspiece 2*c*. The slider 2 is always mounted at least at three points in or on the guide rail 6 and is thus retained in a rotationally fixed manner in the guide rail 6, it being possible for the slider to be moved in the running direction F of the guide rail 6. In this case, the crosspiece 2*c* acts on the inner surfaces 6*d* of the rail 6 by way of its two side surfaces 2*k*. Arranged above the guide part 2 is carrying part 3, on the surface of which it is possible to arrange on [sic] conveyable object.

FIG. 9 shows a side view of a curved guide rail 6 on which a rail-guidable conveying means 1 is mounted. As is illustrated in FIGS. 1, 2 and 3, the guide part 2 is likewise configured so as to run in the form of V in the conveying direction F and is also of H-shaped configuration. At their end region which is directed away from the crosspiece 2*c*, the V-shaped sliding bodies 2*a*, 2*b* each have a tapered section 2*o*, and these are configured such that, as is illustrated in FIG. 9, the interspace between the two sliding bodies 2*a*, 2*b* widens. This configuration has, for example, the advantage that it is also possible for the conveying means 1 to be conveyed with low friction in curved rail sections 6. Of course, it would also be possible for just one of the two sliding bodies 2*a*, 2*b* to have a tapered section 2*o*.

What is claimed is:

1. Rail-guidable conveying means (1) for conveying, in particular, sheet-like products in a conveying direction (F), comprising a guide part (2), which runs in the form of a V in the conveying direction (F) and forms a three-point support, a carrying part (3), which is arranged firmly on the guide part (2) and is intended for retaining the product, and a coupling part (4), which is configured such that it can be coupled to a drive means (9).

2. Conveying means according to claim 1, characterized in that the guide part (2) is of H-shaped configuration in a plane normal to the conveying direction (F).

3. Conveying means according to claim 2, characterized in that the guide part (2) comprises two V-shaped sliding bodies (2*a*, 2*b*) which are spaced apart perpendicularly to the conveying direction (F) and are connected by a crosspiece (2*c*).

4. Conveying means according to claim 3, characterized in that the two sliding bodies (2*a*, 2*b*) are arranged congruently in relation to a direction (Z) which runs perpendicularly to the conveying direction (F).

5. Conveying means according to claim 1 or 2 or 3 or 4, characterized in that the crosspiece (2*c*) has an overall length (L4) in the conveying direction (F) and a width (B4) in a direction (Y), which runs perpendicularly to the conveying direction (F), and in that the overall length (L4) is at least twice, preferably approximately 3 times, the width (B4), and/or in that the guide part (2) has an overall length (L2), and the overall length (L2) of the guide part (2) is at least 1.5 times the overall length (L4) of the crosspiece (2*c*).

6. Conveying means according to claim 2 or 3 or 4, characterized in that the V-shaped sliding body (2*a*; 2*b*) has two side arms which have a leading edge (2*m*) and a trailing edge (2*l*), as seen in the conveying direction (F), and in that the two edges (2*m*, 2*l*) run parallel to one another.

7. Conveying means according to claim 2 or 3 or 4, characterized in that the V-shaped sliding body (2*a*; 2*b*) has two side arms which have a leading edge (2*m*) and a trailing edge (2*l*), as seen in the conveying direction (F), and in that the two edges (2*m*, 2*l*) run in a wedge-shaped manner in relation to one another in order to form side arms which taper in the outward direction.

8. Conveying means according to claim 2 or 3 or 4, characterized in that, at its end region which is directed away from the crosspiece (2*c*), the V-shaped sliding body (2*a*; 2*b*) has an engagement means (2*g*), in particular configured as a notch or a hook, and/or has a tapered section (2*o*).

9. Conveying means according to claim 2 or 3 or 4, characterized in that the coupling part (4) is formed by the sliding body (2*a*; 2*b*), which consists of a ferromagnetic material.

10. Conveying means according to claim 2 or 3 or 4, characterized in that the coupling part (4) is configured as a part which is fixed to the sliding body (2*a*; 2*b*) and is made of ferromagnetic material.

11. Conveying means according to claim 1 or 2 or 3 or 4, characterized in that a retaining means (8) is configured, and arranged on the carrying part (3), such that an, in particular, sheet-like product can be retained.

12. Rail-guidable conveying means of the type adapted for guiding a conveying means having a H-shaped guide part running in the form of two V-shaped sliding bodies in the conveying direction, including a connecting crosspiece, and forming a three-point support with a carrying part arranged firmly on the guide part that functions as a retainer for a product, and a coupling part configured to be coupled to a drive means, the guide rail comprising: two parallel rails which form a gap (7) and are configured in adaptation to the H-shaped guide part such that the crosspiece (2*c*) can be mounted in a movable manner in the gap (7) and each sliding body (2*a*, 2*b*) comes to rest on opposite sides of the rails (6).

13. Rail-guidable conveying means according to claim 12, characterized in that each rail (6) has an outer rail part (6*a*) which forms an inner surface (6*c*) which runs in the conveying direction (F) and is directed toward the gap (7), and in that the distance between the gap (7) and the inner surface (6*c*) is selected such that the inner surface (6*c*) forms a lateral directing surface for the sliding body (2*a*; 2*b*) of the guide part (2).

14. Rail-guidable conveying means according to claim 12, characterized in that the rails (6) are configured in adaptation to the guide part (2) such that the guide part (2) arranged on the rail (6) has an amount of play.

15. A rail-guidable conveying means (1) according to one of claims 1 or 2 or 3 or 4 and a guide rail having two parallel rails (6) which form a gap in adaptation to the H-shaped guide means (2) such that the crosspiece (2*c*) can be mounted in a movable mariner in the gap (7) and each sliding body (2*a*, 2*b*) comes to rest on opposite sides of the rails (6) for conveying sheet-like products, in particular printed products.

16. Rail-guidable conveying means according to claim 13, characterized in that the rails (6) are configured in adaptation to the guide part (2) such that the guide part (2) arranged on the rail (6) has an amount of play.

17. Rail-guidable conveying means (1) according to claim 15 characterized in that the rail (6) has an outer rail part (6*a*) which forms an inner surface (6*c*) which runs in the conveying direction (F) and is directed toward the gap (7), and in that the distance between the gap (7) and the inner surface (6*c*) is selected such that the inner surface (6*c*) forms a lateral directing surface for the sliding body (2*a*; 2*b*) of the guide part (2).

18. A rail-guidable conveying means (1) according to claim 15 characterized in that the rail (6) is configured in adaptation to the guide part (2) such that a guide part (2) arranged on the rail (6) has an amount of play.

* * * * *

UNITED STATES PATENT AND TRADEMARK OFFICE

CERTIFICATE OF CORRECTION

PATENT NO. : 6,386,356 B1
DATED : May 14, 2002
INVENTOR(S) : Jürg Eberle

It is certified that error appears in the above-identified patent and that said Letters Patent is hereby corrected as shown below:

Column 8,
Line 17, after "gap" insert -- (7) and are configured --.
Line 19, delete "mariner" and substitute -- manner -- in its place.

Signed and Sealed this

Seventeenth Day of June, 2003

JAMES E. ROGAN
*Director of the United States Patent and Trademark Office*